US008540118B2

(12) United States Patent
McDonald et al.

(10) Patent No.: US 8,540,118 B2
(45) Date of Patent: Sep. 24, 2013

(54) WATER DISPENSER AND METHOD OF OPERATING IT

(75) Inventors: Neil McDonald, Georgetown, IN (US); Daniel Capelle, Corydon, IN (US); Daniel Brosnan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 212 days.

(21) Appl. No.: 12/916,658

(22) Filed: Nov. 1, 2010

(65) Prior Publication Data

US 2012/0104031 A1 May 3, 2012

(51) Int. Cl.
*B67D 1/00* (2006.01)

(52) U.S. Cl.
USPC ..... 222/40; 222/1; 222/56; 222/62; 222/64; 222/67; 222/68; 222/185.1; 222/638; 222/639

(58) Field of Classification Search
USPC ..... 222/1, 40, 52, 56, 62, 64–68, 185.1, 222/638–639
See application file for complete search history.

(56) References Cited

U.S. PATENT DOCUMENTS 4,561,566 A * 12/1985 Slobodnik ..... 222/56
4,792,059 A * 12/1988 Kerner et al. ..... 222/67
4,969,991 A * 11/1990 Valadez ..... 210/96.2
5,540,362 A * 7/1996 Azuma et al. ..... 222/642
6,448,174 B1 * 9/2002 Ramm ..... 438/637
6,453,955 B1 * 9/2002 Lee ..... 141/198
6,793,099 B1 * 9/2004 Sleiman ..... 222/67
6,793,102 B2 * 9/2004 Tan et al. ..... 222/185.1
6,868,986 B1 * 3/2005 Arnold ..... 222/66
7,044,175 B1 * 5/2006 Camejo ..... 141/18
7,597,215 B2 * 10/2009 Sleiman ..... 222/65
7,874,325 B2 * 1/2011 Tyler et al. ..... 141/309
7,878,372 B1 * 2/2011 Camejo ..... 222/64

* cited by examiner

*Primary Examiner* — Frederick C Nicolas
(74) *Attorney, Agent, or Firm* — Global Patent Operations; Douglas D. Zhang

(57) ABSTRACT

A water dispenser is fluidly connectable to a water source. The water dispenser includes a water tank; a faucet fluidly connected to the water tank and configured to generate an activation signal after being activated; a valve fluidly connectable to the water source and fluidly connected to the water tank; a first float switch movably disposed in the water tank and configured to generate an open signal after moving away from a predetermined position; and a controller operatively connected to the faucet and the first float switch. The controller is configured to open the valve to refill the water tank with water from the water source after the controller receives both the activation signal from the faucet and the open signal from the first float switch. A method of operating the water dispenser is also disclosed.

18 Claims, 4 Drawing Sheets

WATER DISPENSER AND METHOD OF OPERATING IT

BACKGROUND OF THE INVENTION

The present disclosure relates generally to water dispensers. More particularly, the present disclosure relates to a point of use water dispenser that has a control system that prevents the water refill valve from refilling the water reservoir or tank when there is a leak in the water dispenser, and a method of operating such a water dispenser.

A point of use water dispenser generally includes a water reservoir or tank fluidly connected to a water refill valve. The water refill valve is in turn fluidly connected to a water source, such as, for example, a tap connected to a municipal water source. The water refill valve controls the amount of water supplied to the water reservoir. Water is preferably passed through a filter to filter the water prior to being deposited in the water reservoir. Generally, a faucet is fluidly connected to the water reservoir, which allows a consumer to draw water from the water reservoir.

A problem in the existing water dispensers is that an internal leak may develop over time, causing property damage due to water spillage. The maximum leakage with the traditional "bottled" water dispensers is limited by the physical size of the bottle. A "plumbed-in" point of use water dispenser, however, has a much higher risk of property damage, as the water supply is unlimited and therefore requires special design considerations to mitigate this risk.

For example, in the point of use water dispensers, if there is a leak, the water refill valve may be controlled to open to refill the water reservoir periodically, only to have the water reservoir drain again in a period of time over the floor of the home or office. If not monitored, a substantial amount of water may be drained from the water reservoir, which can cause relatively considerable amount of damage to the home or office. Generally, a customer will be very displeased since if the customer is not closely monitoring the water dispenser then a considerable amount of spillage may potentially occur over a relatively short period of time.

BRIEF DESCRIPTION OF THE INVENTION

As described herein, the various exemplary embodiments of the present invention overcome one or more of the above or other disadvantages known in the art.

One aspect of the present disclosure relates to a water dispenser that is fluidly connectable to a water source. The water dispenser includes a water tank; a faucet fluidly connected to the water tank and configured to generate an activation signal after being activated; a valve fluidly connectable to the water source and fluidly connected to the water tank; a first float switch movably disposed in the water tank and configured to generate an open signal after moving away from a predetermined position; and a controller operatively connected to the faucet and the first float switch. The controller is configured to open the valve to refill the water tank with water from the water source after the controller receives both the activation signal from the faucet and the open signal from the first float switch.

Another aspect of the present disclosure relates to a method of controlling a water dispenser. The water dispenser includes a water tank, a faucet fluidly connected to the water tank, a valve fluidly connectable to a water source and fluidly connected to the water tank. The method includes opening the valve to refill the water tank with water from the water source only after receiving an activation signal from the faucet and an open signal from a first float switch movably disposed in the water tank.

These and other aspects and advantages of the present disclosure will become apparent from the following detailed description considered in conjunction with the accompanying drawings. It is to be understood, however, that the drawings are designed solely for purposes of illustration and not as a definition of the limits of the disclosure, for which reference should be made to the appended claims. Moreover, the drawings are not necessarily drawn to scale and that, unless otherwise indicated, they are merely intended to conceptually illustrate the structures and procedures described herein.

BRIEF DESCRIPTION OF THE DRAWINGS

FIG. 2 also shows the tubing and the water tap valve that are used to connect the water dispenser to a municipal water supply.

DETAILED DESCRIPTION OF THE EXEMPLARY EMBODIMENTS OF THE INVENTION

It is contemplated that the teaching of the present disclosure set forth below is applicable to all types of water dispensing devices, including but not limited to, point of use water dispensers, water filtration devices, consumer water dispensers, commercial water dispensers, household refrigerators, or water bottling devices. The present disclosure is therefore not intended to be limited to any particular apparatus or configuration described in the exemplary embodiments of the present disclosure. It should be appreciated that the present disclosure may be applicable to other types of appliances that dispense water or fluid including commercial refrigerators, appliances with faucets, icemakers, water bottlers, food manufacturing equipment, freezers, or any other type of appliance that may include a point of use water dispenser known in the art.

Figure 1:
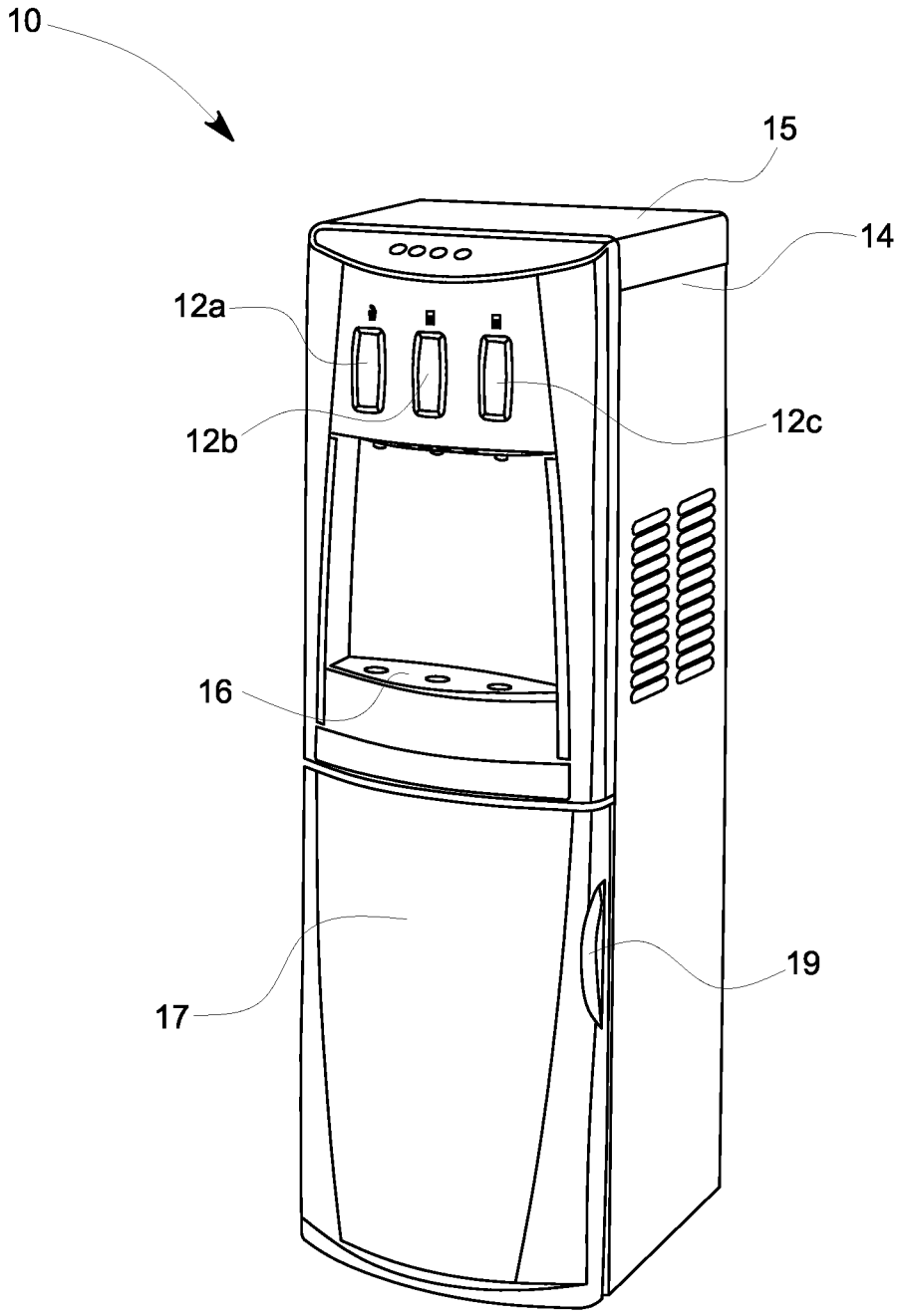
FIG. 1 is a perspective view of a point of use water dispenser according to an exemplary embodiment of the present disclosure.

FIG. 1 illustrates a point of use water dispenser 10 including, among other things, a housing 14 and a dispenser shelf 16 where a user may place a cup to receive water. The point of use water dispenser 10 also includes a cover 17 located in a lower portion of the water dispenser 10 that is secured via a hinge or the like to the chassis of the water dispenser and has a handle 19 for facilitating the opening of the cover 17 to reveal one or more interior components of the water dispenser 10. The water dispenser 10 includes switches or faucets 12*a*, 12*b*, 12*c* for dispensing hot water, room temperature water, or cold temperature water from respective outlets. Other configurations are possible and the water dispenser 10 is not limited to the three switches 12*a*, 12*b*, 12*c* shown. The water dispenser 10 is shown as a so called "bottle-less" dispenser where a water reservoir 205 (shown in FIG. 4) is placed inside the housing 14; however, the present disclosure encompasses a bottle configuration where a water bottle is placed on a top side 15 of the housing 14 to fill the water reservoir 205.

The water dispenser 10 advantageously limits water leakage or does not allow an endless flow of water escaping from the water dispenser 10 from the municipal water supply. Such leakage may damage the floor of the home or office. Instead, the water dispenser 10 will only open a refill valve to refill the water reservoir 205 when certain conditions are met. If there is a leakage, the water dispenser 10 will not dispense water in an endless manner.

Figure 2:
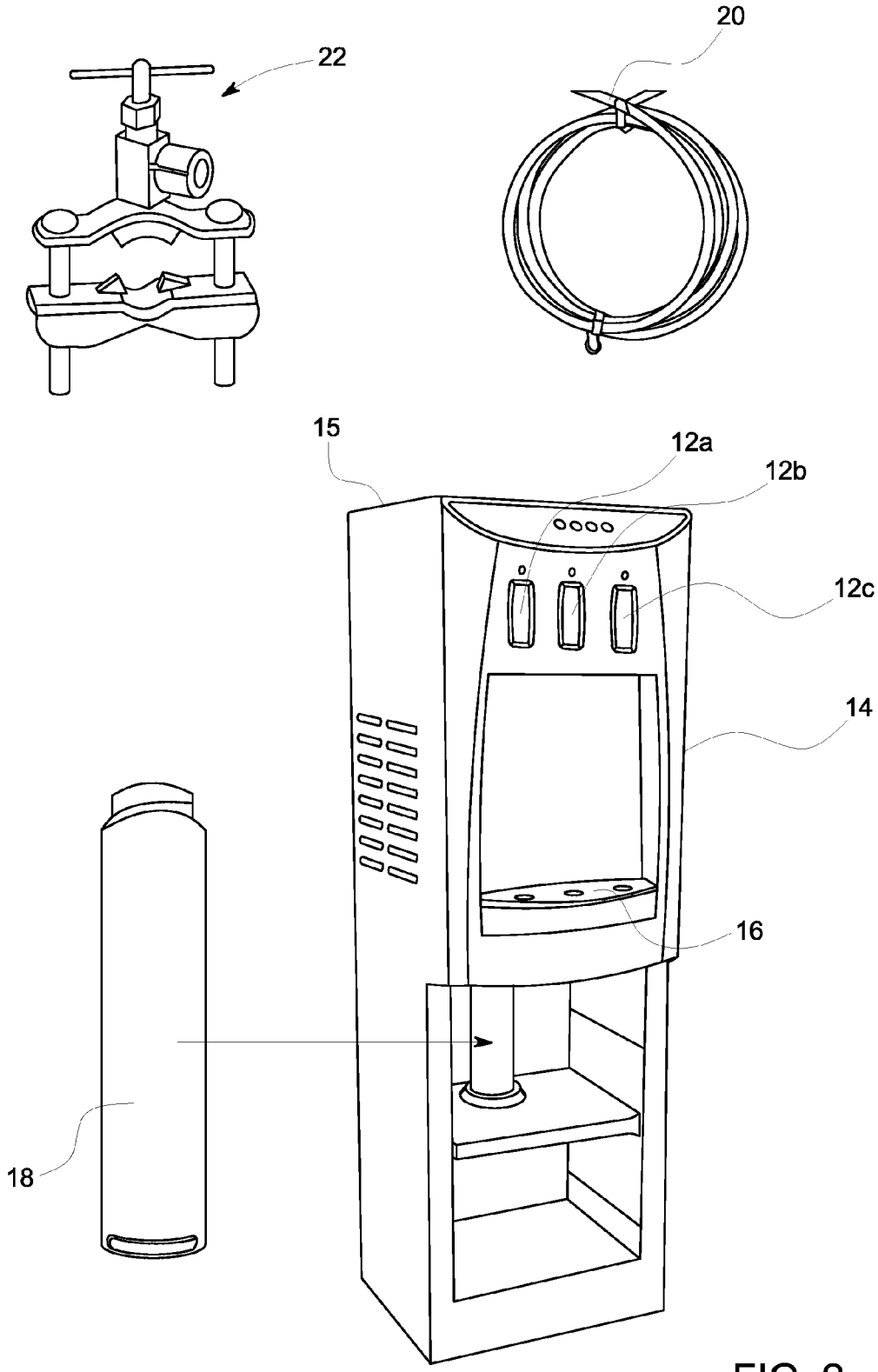
FIG. 2 is another perspective view of the water dispenser of FIG. 1, with a cover being removed to show a water filter therein.

Turning now to FIG. 2, the water dispenser 10 preferably includes a water filter 18 that is disposed in the housing 14 under the shelf 16 for a single stage filtration of the water in the water dispenser 10. A tubing 20 fluidly connects the water dispenser 10 to a water tap valve 22. In operation, the municipal water supply is connected to the water tap valve 22. The water tap valve 22 shown in FIG. 2 is typically known as a saddle valve. Water will flow from the municipal water supply through the water tap valve 22 and through the tubing 20 into the point of use water dispenser 10 where the filtration of the water occurs.

Figure 3:
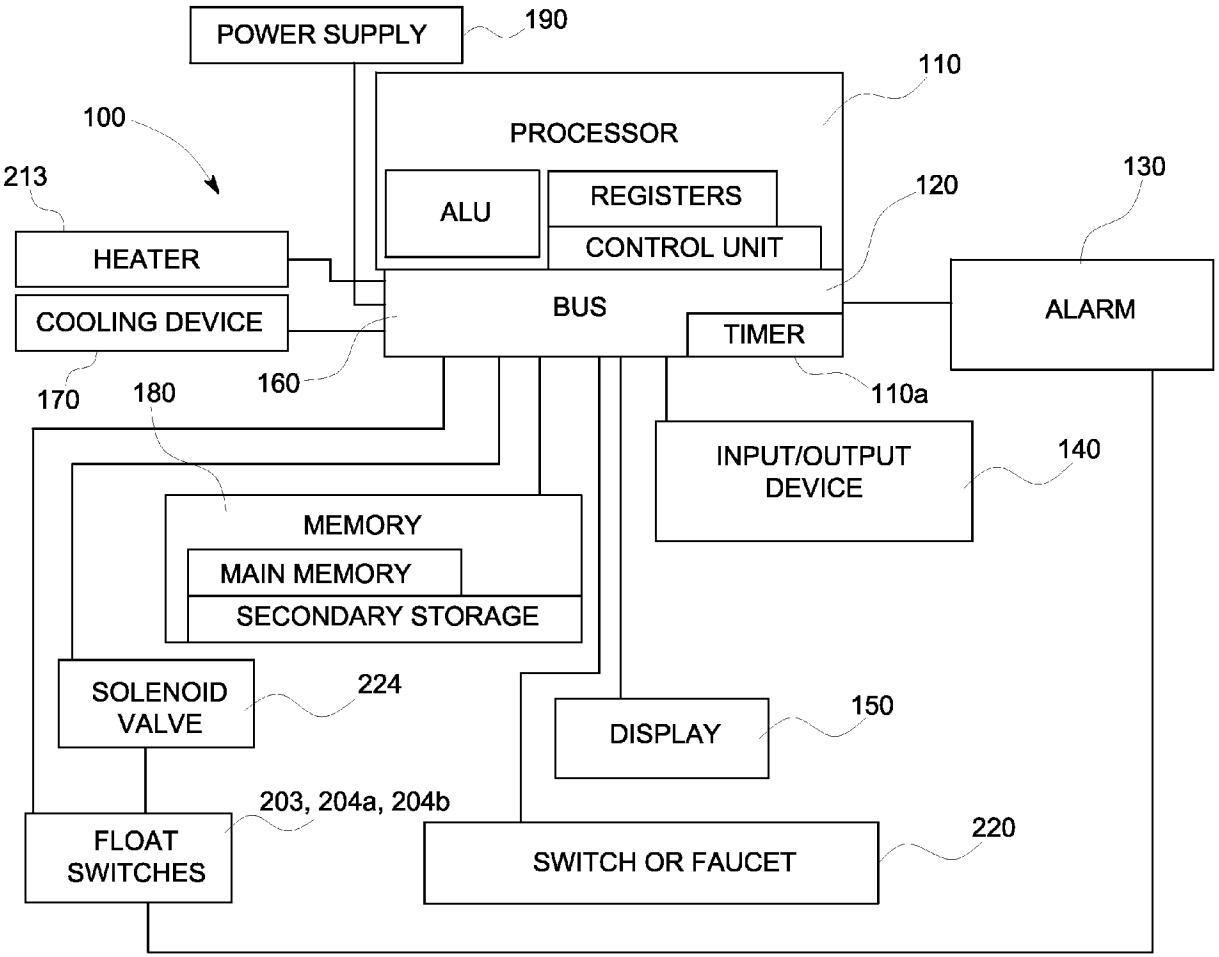
FIG. 3 is block diagram of the water dispenser of FIG. 1, schematically showing some components of the water dispenser.

Turning now to FIG. 3, there is shown a simplified block diagram of the water dispenser 10. The water dispenser 10 includes a computing device 100 that includes a controller 110 that may be a digital signal processor manufactured with an arithmetic logic unit (ALU), a control unit and registers as is known in the art. Alternatively, the controller 110 can be a digital control circuit or an analog circuit. The controller 110 is configured to deliver control signals to various components of the water dispenser 10. Various configurations are possible and within the scope of the present disclosure, and therefore the configurations shown therein form no limitations to the present disclosure.

The controller 110 is operatively connected to a bus 120. As is known in the art, the bus 120 enables communications between the controller 110 and other components of the water dispenser 10 so that the controller 110 can control the operation of these components.

As illustrated in FIG. 3, in one embodiment, the bus 120 is operatively connected to a memory 180 that may include a main memory and secondary storage for storing executable program instructions and for writing to the memory 180 as is known in the art, to an input/output device 140 (such as a keyboard, a touch screen), to a display 150 which is used for displaying/monitoring one or more conditions of the water dispenser 10, to a heater 213 and a cooling device 170 that are selectively used to control the temperature of the water to be dispensed by the water dispenser 10, to an alarm 130 that can be used to alert the user of one or more conditions of the water dispenser 10, to a timer 110*a*, to a refill valve such as a solenoid valve 224 for the water reservoir 205, to float switches 203, 204*a*, and 204*b*, and to a switch or faucet 220 which corresponds to one of the faucet 12*a*, 12*b*, 12*c* shown in FIG. 1. A power supply 190 provides electricity to many components of the water dispenser 10.

Figure 4:
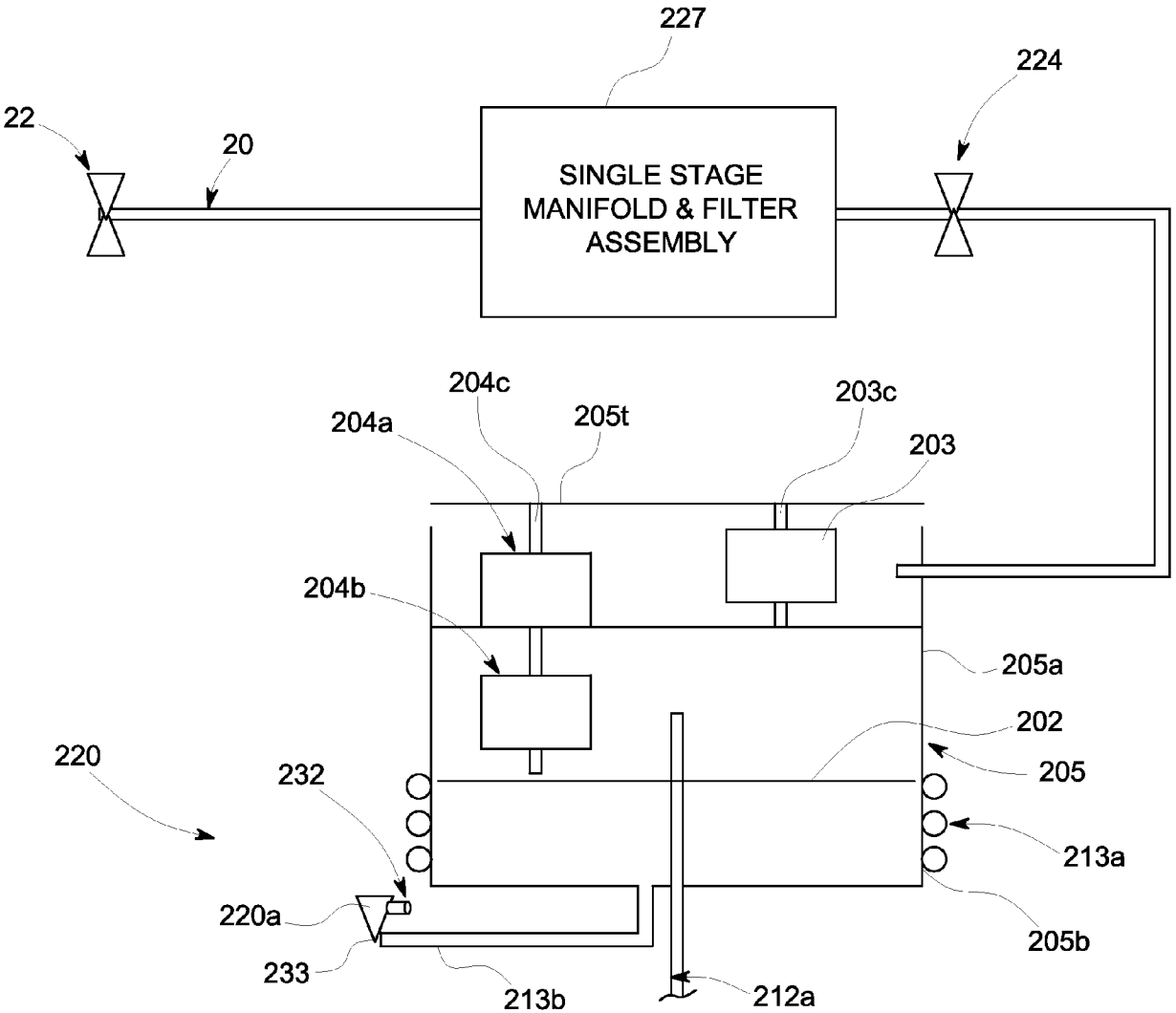
FIG. 4 is a simplified, partial view of the water dispenser of FIG. 1, schematically showing some components of the water dispenser.

Turning now to FIG. 4, operation of the water dispenser 10 that provides improved control and eliminates endless leakage will be described. The saddle valve 22 of FIG. 4 is fluidly connected to a municipal water supply as discussed above in connection with FIG. 2. The tubing 20 fluidly connects the saddle valve 22 to a single stage manifold and filter assembly 227. The filter of the assembly 227, which corresponds to the filter 18 in FIG. 2, may include various filter media. The filter media may include a surface filter, or a solid sieve which traps the solid particles, with or without the aid of filter paper (e.g., Buchner funnel, belt filter, rotary vacuum-drum filter, cross flow filters), or a second depth filter (a bed of granular material which retains the solid particles as it passes). The single stage manifold and filter assembly 227 filters particulates from the municipal water and communicates the filtered water to the solenoid valve 224, which is then communicated to the water reservoir 205 as discussed herein.

The solenoid valve 224, which is an electromechanical valve controlled by an electric current through a solenoid coil, may be opened to release water into the water reservoir tank 205. Other types of valves can be used, but solenoid valve is preferred because it offers fast and safe switching, is highly reliable, and has a relatively long service life, low power requirements and a compact design. The solenoid valve 224 preferably has two ports—one port for receiving water from the single stage manifold and filter assembly 227 and the other port for releasing water into the water reservoir 205 and then to a hot water reservoir or tank (not shown) via a flow connection 212*a*. However, the solenoid valve 224 may have more than two ports.

In the case of a two-port solenoid valve 224 the flow is switched on or off by the electrical current. It should be appreciated that the present water dispenser 10 advantageously uses a single solenoid valve 224. This configuration is advantageous as the solenoid valve 224 is relatively expensive. By using just one solenoid valve 224 instead of multiple solenoid valves, the production costs for the water dispenser 10 can be lower. However, multiple solenoid valves can be used. For example, the water dispenser 10 can have two solenoid valves, the second valve being used to supply water from the single stage manifold and filter assembly 227 to the hot water reservoir directly without using the flow connection 212*a*. The solenoid valve 224 is used to release water into the water reservoir 205 when opened and to terminate releasing water into the water reservoir 205 when closed.

A separator plate 202 is disposed in the water reservoir 205 to roughly divide the water reservoir 205 into a first portion 205*a* and a second portion 205*b*. In the embodiment shown in FIG. 4, the separator plate 202 does not seal the first portion 205*a* relative to the second portion 205*b* so that these portions 205*a*, 205*b* are still fluidly connected to each other. The cooling device 170 shown in FIG. 3 includes an evaporator 213*a* of a sealed refrigeration system. The evaporator 213*a* surrounds the second portion 205*b* to primarily cool the water contained in the second portion 205*b* while not covering at all the first portion 205*a*. In this manner, the first portion 205*a* holds relatively warm or room temperature water while the second portion 205*b* holds relatively cold water. Preferably, the inlet end of the flow connection 212*a* is disposed in the first portion 205*a* so that water flowing into the hot water reservoir is relatively warm. As is known in the art, the hot water reservoir is heated by the heater 213 (FIG. 3) which can be, for example, an electric heater.

Preferably, an upper float switch 204*a*, a lower float switch 204*b* and a warning or third float switch 203 are disposed in the first portion 205*a* of the water reservoir 205. In the embodiment shown, the upper float switch 240*a* and the lower float switch 204*b* share a common anchoring post 204*c* which is supported by the top 205*t* of the water reservoir 205, and the warning float switch 203 has its own anchoring post 203*c* which is also supported by the top 205*t*. In the embodiment shown in FIG. 4, at their lowermost positions, the upper float switch 204*a* is disposed above the lower float switch 204*b*, but below the warning float switch 203. In one embodiment, the warning float switch 203, in its lowermost position, is higher than the upper float switch 204*b* when the upper float switch 204*b* is in its uppermost floating position. These float switches are known in the art, and the function of these float switches in the embodiments will be apparent from the following discussions.

The switch or faucet 220 is fluidly connected to the second portion 205*b* of the water reservoir 205 through the flow connection 213*b*. The switch or faucet 220 preferably has a mechanical valve 220*a* with an outlet 233, and a micro switch 232 which is operatively connected to the mechanical valve 220*a* and is schematically illustrated in FIG. 4. The micro switch 232 is also operatively connected to the controller 110. Activating the mechanical valve 220*a* will activate the micro switch 232 by opening or closing circuit of the micro switch 232, and such opening or closing will send a signal to the controller 110. Similarly, deactivating the switch or faucet 220 will close or open the circuit of the micro switch 232, and such closing or opening will send another, different signal to the controller 110.

In the embodiment shown in FIG. 4, each of the first portion 205*a* of the water reservoir 205 and the hot water reservoir has its own switch or faucet (not shown), which is fluidly connected to the first portion 205*a* or the hot water reservoir by a separate flow connection (not shown) and corresponds to the respective one of the switches 12*a*, 12*b* and 12*c* shown in FIG. 1. In another embodiment, only one switch or faucet can be used, which is then fluidly connected to the first portion 205*a*, the second portion 205*b* and the hot water reservoir, respectively, in a known manner.

After the installation of a new water dispenser 10 which has no water in the water reservoir 205, all three float switches 203, 204*a*, 204*b* are in their lowermost positions. Activating the mechanical valve 220*a* of the faucet 220 will activate the micro switch 232, which will then send a signal to the controller 110 to activate or open the solenoid valve 224 to fill the water reservoir 205 with water. The solenoid valve 224 will remain open even if the user deactivates the mechanical valve 220*a* at this point. As the solenoid valve 224 remains open, water will be supplied to the water reservoir 205 and water level in the water reservoir 205 will raise to move the lower float switch 204*b* upward from its lowermost position. In one embodiment, the lower float switch 204*b* is configured to send a signal to the controller 110 to activate the cooling device 170 and/or the heater 213 when it moves from its lowermost position to an upper position such as its uppermost floating position. The solenoid valve 224 remains open to fill the water reservoir 205 with water until the upper float switch 204*a* moves upward and/or reaches a predetermined upper position such as its uppermost floating position, at which position the upper float switch 204*a* sends a signal to the controller 110 to deactivate or close the solenoid valve 224.

At this initial water filling stage, the controller 110 can be programmed or configured to use the timer 110*a* to limit the on-time of the solenoid valve 224 to a predetermined period of time. The predetermined period of time is chosen so that if everything works as planned, water in the water reservoir 205 will reach its designed maximum water level within this predetermined period of time. This on-time limit prevents burn-out damages to the solenoid valve 224 when there is an incomplete or improper installation or when municipal water supply is shut off for some reasons. The controller 110 can be programmed or configured to activate the alarm 130 and/or to turn on the display 150 if one or both of the lower and upper float switches 204*b*, 204*a* do not reach their uppermost floating positions within the predetermined period of time. In one embodiment, the predetermined period of time is approximately 4 minutes.

FIG. 4 shows that the water reservoir 205 has the designed maximum water level so that both the upper and lower float switches 204*a*, 204*b* are in their uppermost floating positions, but the warning float switch 203 remains in its lowermost position. If a user activates the mechanical valve 220*a*, water will be dispensed from the water reservoir 205, and the water level in the water reservoir 205 will decrease, which will cause the upper float switch 204*a* and/or both the upper and lower float switches 204*a*, 204*b* to move from their uppermost floating positions to lower positions. In one embodiment, it is the lower float switch 204*b* that will send an open signal to the controller 110 when it moves downward from its uppermost floating position, but the upper float switch 204*a* may be used instead to send this open signal. As discussed earlier, activation of the mechanical valve 220*a* will also activate the micro switch 232 which will then send an activation signal to the controller 110. The controller 110 will send a signal to open the solenoid valve 224 to refill the water reservoir 205 with water only after it receives both the open signal from one of the upper and lower float switches 204*a*, 204*b*, and the activation signal from the micro switch 232 of the switch or faucet 220.

The controller 110 may be programmed or configured so that it requires not only the receipt of the two signals (i.e., the activation signal and the open signal) but also the receipt of the two signals in a sequence (i.e., the activation signal no later than the open signal). This allows for a redundancy and safe operation, as the water reservoir 205 will not be continuously refilled if the water dispenser 10 is leaking.

Furthermore, the controller 110 may be programmed or configured so that it will activate the solenoid valve 224 after receiving the two signals and the expiration of a predetermined period of time. Delay is preferred here because more mixing of water in the water reservoir 205 while water is being dispensed from the water dispenser 10 is not desirable because if there is a substantial temperature difference between the water dispensed and the water temperature expected by a user, the user may infer incorrectly that the water dispenser is malfunctioning. The delay may be under a minute, about a minute or about several minutes, depending on the size of the water reservoir 205 and the water dispensing ratio. The controller 110 can use the timer 110*a* to count the delay, and start to activate the solenoid valve 224 immediately after the expiration of the predetermined period of time which starts, for example, when the upper float switch 203*a* moves downward from its uppermost floating position, when the upper float switch 203*a* reaches its lowermost position, when the lower float switch 203*b* moves downward from its uppermost floating position, or when the lower float switch 203*b* reaches its lowermost position.

Once activated, the solenoid valve 224 remains open until water in the water reservoir 205 moves the upper float switch 204*a* upward from its lowermost position and/or reaches its uppermost floating position, at which position the upper float switch 204*a* sends a close signal to the controller 110 to deactivate or close the solenoid valve 224.

The lower float switch 204*b* can be used to deactivate the cooling device 170 and/or the heater 213. For example, when the lower float switch 204*b* moves from its uppermost floating position to a lower position such as its lowermost position, it sends a signal to the controller 110 to deactivate the cooling device 170 and/or the heater 213. Of course, the upper float switch 204*a* can be used for this purpose also.

The lower float switch 204*b* can also be used to provide a signal to the controller 110 to start the timer 110*a*. The timer 110*a* sets the time cycle that the solenoid valve 224 is allowed to stay open. At the commencement of the time cycle, the solenoid valve 224 is opened. At the conclusion of the time cycle, the solenoid valve 224 is closed. The time cycle may include various different cycles and may depend on the water holding capacity of the water dispenser 10, mass flow rate of water through components of the water dispenser 10 and other factors and may be programmed accordingly. For example, in the event that the mechanical valve 220*a* remains activated or open, the solenoid valve 224 will remain activated or open only for a predetermined period of time, such as for example approximately 7 minutes, after the controller 110 sends a signal to activate the solenoid valve 224. This feature prevents damages to the solenoid valve 224 due to forced continuous operation by the user when the user keeps the mechanical valve 220*a* in an activated state. The controller 110 resets the time cycle whenever the upper float switch 204*a* reaches its uppermost floating position and sends a close signal to the controller 110 to deactivate the solenoid valve 224, or whenever the mechanical valve 220 is deactivated or closed, for example.

The warning float switch 203 is disposed a predetermined distance higher than the upper float switch 204*a*. The predetermined distance can be less than a height of an individual float switch as shown. The warning float switch 203 is optional. In one embodiment, the warning float switch 203 is directly wired or connected (i.e., a direct connection without passing through the controller 110) to the solenoid valve 224. When there is a malfunction in the upper float switch 204*a* and/or the controller 110 while the solenoid valve 224 is still activated and water is still supplied to the water reservoir 205, the warning float switch 203 will deactivate the solenoid valve 224 and therefore shut down the water supply to the water reservoir 205 when, for example, it moves upward from its lowermost position or when it reaches its uppermost floating position. In this manner, the warning float switch 203 prevents overfilling the water reservoir 205 and spill of water onto the floor of the home or office. The warning float switch 203 can also be directly wired to the alarm 130 so that once the warning float switch 203 is triggered when it moves upward from its lowermost position or reaches its uppermost floating position, the alarm 130 will be triggered to warn a user, audibly and/or visually, that there is a malfunction in the water dispenser 10.

It should be appreciated that generally the controller 110 may receive signals from the mechanical valve 232 and float switches 203, 204*a*, 204*b* to control the solenoid valve 224 that are not simultaneous. It should be appreciated that the controller 110 may search for signals from the mechanical valve 232 and float switches 203, 204*a*, 204*b* continuously and receive the signals simultaneously and also over a predetermined time frame and then output control commands.

Thus, while there have shown and described and pointed out fundamental novel features of the disclosure as applied to various specific embodiments thereof, it will be understood that various omissions and substitutions and changes in the form and details of the apparatus illustrated, and in their operation, may be made by those skilled in the art without departing from the spirit of the disclosure. For example, since the first portion 205*a*, the second portion 205*b* and the hot water reservoir are fluidly connected to each other, they are considered as forming one water tank in the present disclosure. Furthermore, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A water dispenser fluidly connectable to a water source, the water dispenser comprising:

a water tank;

a faucet fluidly connected to the water tank and configured to generate an activation signal after being activated;

a valve fluidly connectable to the water source and fluidly connected to the water tank;

a first float switch movably disposed in the water tank and configured to generate an open signal after moving away from a predetermined position; and a controller operatively connected to the faucet and the first float switch, the controller being configured to open the valve to refill the water tank with water from the water source in response to both the activation signal from the faucet and the open signal from the first float switch.

2. The water dispenser of claim 1, wherein the first float switch is movable between a first uppermost floating position and a first lowermost position, the predetermined position being the first uppermost floating position.

3. The water dispenser of claim 2, further comprising a second float switch disposed in the water tank and movable between a second uppermost floating position and a second lowermost position, the second lowermost position being lower than the first lowermost position.

4. The water dispenser of claim 2, further comprising a second float switch disposed in the water tank and movable between a second uppermost floating position and a second lowermost position, the second lowermost position being higher than the first lowermost position.

5. The water dispenser of claim 4, wherein the second float switch is configured to generate a close signal after the second float switch moves upward from the second lowermost position, the controller closing the valve after receiving the close signal.

6. The water dispenser of claim 4, wherein the second float switch is configured to generate a close signal after the second float switch reaches the second uppermost floating position, the controller closing the valve after receiving the close signal.

7. The water dispenser of claim 4, further comprising a third float switch disposed in the water tank and directly connected to the valve, the third float switch being movable between a third uppermost floating position and a third lowermost position which is higher than at least one of the second lowermost position and the second uppermost floating position, the third float switch being configured to close the valve after the third float switch moves upward from the third lowermost position.

8. The water dispenser of claim 4, further comprising a third float switch disposed in the water tank and directly connected to the valve, the third float switch being movable between a third uppermost floating position and a third lowermost position which is higher than at least one of the second lowermost position and the second uppermost floating position, the third float switch being configured to close the valve after the third float switch reaches the third uppermost floating position.

9. The water dispenser of claim 1, wherein the controller is configured to open the valve to refill the water tank with water from the water source after the controller receives the activation signal and the open signal in a predetermined sequence.

10. The water dispenser of claim 1, wherein the controller is configured to open the valve to refill the water tank with water from the water source in response to both the activation signal and the open signal and immediately after expiration of a predetermined period of time, and wherein the predetermine period of time starts when the faucet generates the activation signal or when the first float switch generates the open signal.

11. The water dispenser of claim 1, wherein the controller is configured to open the valve for a predetermined period of time, and wherein the predetermine period of time starts when the faucet generates the activation signal or when the first float switch generates the open signal.

12. The water dispenser of claim 11, wherein the predetermined period of time is approximately 7 minutes.

13. The water dispenser of claim 10, wherein the predetermined period of time is under a minute, about a minute or above several minutes.

14. The water dispenser of claim 4, further comprising a third float switch disposed in the water tank and operatively connected to the controller, the third float switch being movable between a third uppermost floating position and a third lowermost position which is higher than at least one of the second lowermost position and the second uppermost floating position, the third float switch being configured to generate a close signal after the third float switch moves upward from the third lowermost position or reaches the third uppermost floating position, the controller closing the valve after receiving the close signal.

15. A method of operating a water dispenser, the water dispenser comprising a water tank, a faucet fluidly connected to the water tank, a valve fluidly connectable to a water source and fluidly connected to the water tank, the method comprising:

opening the valve to refill the water tank with water from the water source in response to both an activation signal from the faucet and an open signal from a first float switch movably disposed in the water tank.

16. The method of claim 15, wherein the opening step occurs immediately after expiration of a predetermined period of time, and wherein the predetermined period of time starts when the activation signal or the open signal is generated.

17. The method of claim 15, wherein the valve remains open for a predetermined period of time, and wherein the predetermined period of time starts when the activation signal or the open signal is generated.

18. The method of claim 17, wherein the predetermined period of time is approximately 7 minutes.

* * * * *